United States Patent [19]

Galaszewski

[11] Patent Number: 4,987,957

[45] Date of Patent: Jan. 29, 1991

[54] DEFLECTOR FOR SIDE WALL SPRINKLER HEAD

[75] Inventor: William Galaszewski, Brookfield, Wis.

[73] Assignee: Star Sprinkler Corporation, Milwaukee, Wis.

[21] Appl. No.: 427,714

[22] Filed: Oct. 27, 1989

[51] Int. Cl.[5] ..... A62C 37/08

[52] U.S. Cl. ..... 169/37; 239/498

[58] Field of Search ..... 169/37, 90, 38, 39, 169/40, 41; 239/498, 500, 504, 518, 522, 523, 524, DIG. 1, DIG. 7

[56] References Cited

U.S. PATENT DOCUMENTS

| | | | |
|---|---|---|---|
| 3,713,492 | 1/1973 | Forrest | 169/37 |
| 3,880,239 | 4/1975 | Vorkapich | 169/37 |
| 4,296,815 | 10/1981 | Mears | 169/37 |
| 4,296,816 | 10/1981 | Fischer | 169/37 |

*Primary Examiner*—Sherman Basinger
*Assistant Examiner*—Stephen P. Avila
*Attorney, Agent, or Firm*—Andrus, Sceales, Starke & Sawall

[57] ABSTRACT

A side wall sprinkler head including a body defining an outlet to be connected to a water line. A pair of arms extend outwardly from the body and are disposed in a common horizontal plane and the ends of the arms are connected at a junction. A cap encloses the outlet in the body and a releasable link interconnects the cap and the junction. When the sprinkler head is exposed to an elevated temperature the link will release the cap permitting water to be discharged from the outlet. The water is distributed in a desired pattern by a deflector which is connected to the junction. The deflector includes a first vertical section and the upper edge of the vertical section is connected via a reverse bend to a horizontal deflector plate. A central tine extends downwardly from the lower edge of the vertical section and a pair of outer tines are disposed on opposite sides of the central tine and extend diagonally downward from the lower edge of the vertical section. The reverse bend is provided with an elongated horizontal aperture, while the vertical section is formed with a pair of horizontally elongated holes which are spaced above the respective outer tines.

9 Claims, 1 Drawing Sheet

DEFLECTOR FOR SIDE WALL SPRINKLER HEAD

BACKGROUND OF THE INVENTION

A side wall sprinkler head is mounted in the side wall of a building or room at a location near the ceiling. The sprinkler head includes a body or frame defining an outlet that is connected to a water line and a pair of frame members or arms extend outwardly from the body and the outer ends of the arms are connected at a junction. A cap encloses the outlet in the body and a releasable link interconnects the junction and the cap. When the sprinkler head is exposed to an elevated temperature, the link will release the cap to enable water to be discharged from the outlet. To distribute the water throughout the room in the desired pattern, a deflector is mounted on the junction, and the deflector is designed with a shape to distribute water to all areas of the room.

In an attempt to achieve this water distribution pattern, it has been proposed, as shown in U.S. Pat. No. 4,296,815, to construct the deflector with a vertical section which is connected to the junction, and the vertical section is connected via a reverse bend to a generally horizontal section which extends outwardly from the vertical section and is positioned normal to a plane passing through the arms of the frame or body. In addition, openings are provided in the vertical section on either side of the axis of the outlet, and a pair of tines extend downwardly and outwardly from the lower end of the vertical section to distribute water to the lower corners of the room.

SUMMARY OF THE INVENTION

The invention is directed to a side wall sprinkler head having a deflector construction which provides a more effective water distribution pattern. In accordance with the invention, the deflector includes a vertical section which is attached to the outer junction of the arms of the sprinkler head body and the upper edge of the vertical section is connected via a reverse bend to a horizontal deflector plate that is disposed parallel to a plane passing through the arms of the body. The bent area is provided with horizontally elongated apertures which are located on either side of the axis of the outlet.

A central tine extends downwardly from the lower edge of the vertical section and is disposed in a vertical plane extending through the axis of the outlet. In addition, a pair of outer tines are located on each side of the central tine, and each outer tine extends downwardly and outwardly from the lower edge of the vertical section. Elongated holes are provided in the vertical section with each hole being disposed above an outer tine.

The horizontal plate and the reverse bend act to direct the water outwardly away from the ceiling, while the openings in the bent area, along with the holes in the vertical plate, aid in directing the water to the outer corners of the room. The central downwardly extending tine helps to wet the wall on which the sprinkler head is mounted, while the outer diagonal tines direct the water into the near corners of the room.

With the sprinkler head construction of the invention a more uniform water pattern is achieved than with conventional side wall sprinklers.

Other objects and advantages will appear in the course of the following description

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
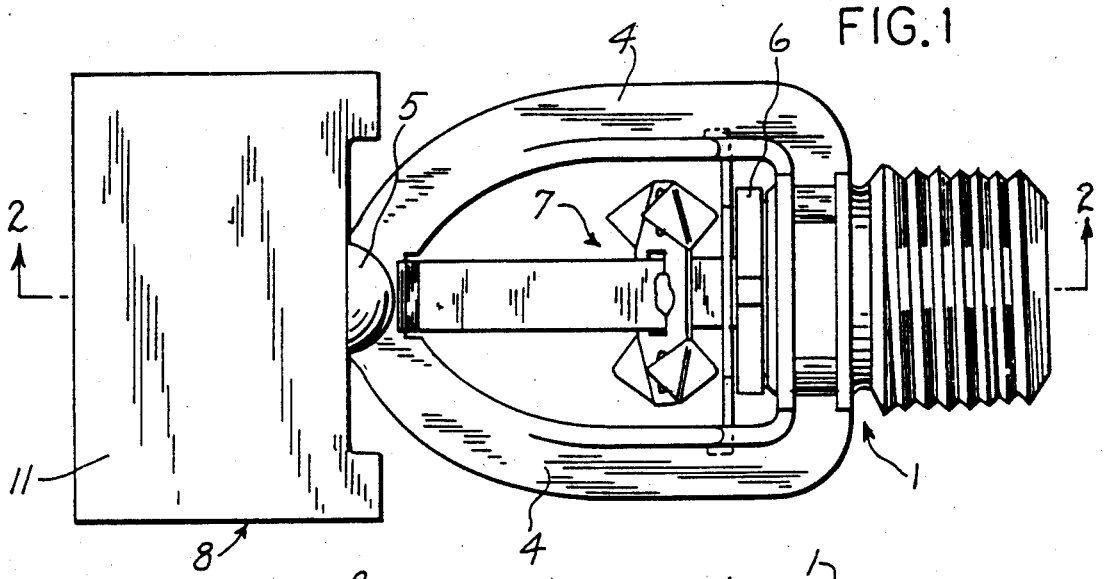
FIG. 1 is a top plan view of the sprinkler head.
Figure 2:
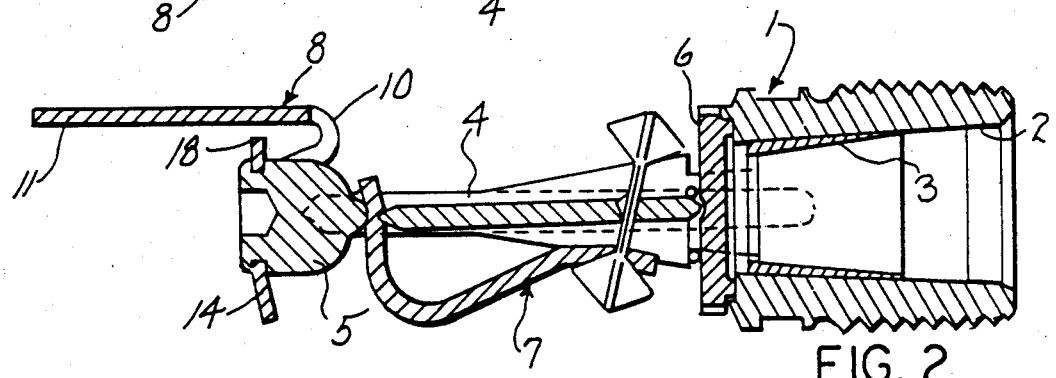
FIG. 2 is a longitudinal section of the sprinkler head.

The drawings illustrate an improved side wall sprinkler head that includes a threaded metal body or frame 1 which is adapted to be connected to a water line. Body 1 defines an outlet 2 and a tapered bushing 3 is mounted within the body 1 adjacent outlet 2.

A pair of generally curved arms 4 extend outwardly from body 1 and the outer ends of arms 4 are connected together at a junction 5.

Outlet 2 is normally enclosed by a cap or valve 6 and a releasable linkage 7 interconnects junction 5 and cap 6 and maintains the cap in a closed position. The releasable linkage 7 preferably includes a fusible metal or solder, and can be constructed in the manner shown in U.S. Pat. No. 4,757,865. When the sprinkler head is exposed to an elevated temperature, the fusible material will melt, releasing the mechanism 7 and enabling the water pressure in the line to dislodge cap 6, thereby permitting the discharge of water from outlet 2.

In accordance with the invention, the water is distributed in a pattern throughout the room, or other area to be protected, by a deflector 8. Deflector 8 includes a generally vertical section 9 that is disposed normal to the axis of outlet 2. Vertical section 9 is provided with a central opening and the edge bordering the central opening is secured in a peripehral groove in junction 5, thus providing a connection for deflector 8 to body 1.

The upper edge of vertical section 9 is connected through reverse bends 10 to a generally horizontal plate 11 which extends outwardly away from body 1. An elongated aperture 12 is located between bent areas 10 and extends to either side of a vertical plane that passes through the axis of outlet 2.

Figure 4:
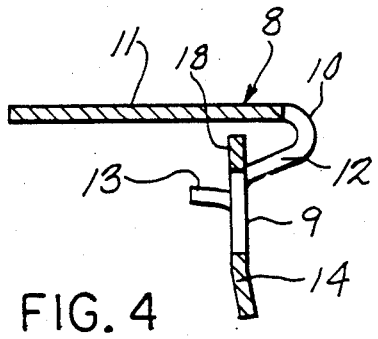
FIG. 4 is a section taken along line 4—4 of FIG. 3.

As shown in FIG. 4, a pair of horizontal flanges 13 extend outwardly from vertical section 9 and are located on either side of the vertical plane passing through the axis of outlet 2.

Extending downwardly from the lower edge of section 9 is a central tine 14, and as seen in FIG. 4, tine 14 is raked rearwardly at an angle of about 10°.

Figure 5:
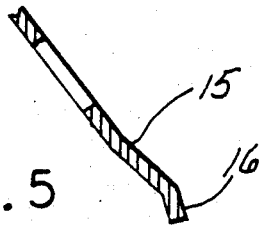
FIG. 5 is a section taken along line 5—5 of FIG. 3.

In addition to central tine 4, a pair of outer tines 15 are connected to the lower edge of section 9 and are spaced outwardly on either side of central tine 14. Outer tines 15 have a greater length than central tine 14 and extend downwardly and outwardly. As illustrated in FIG. 5, the lower portion of each tine 15 is raked rearwardly at an angle of about 10°and the lower end 16 of each tine is bent forwardly at an angle of about 25°.

Figure 3:
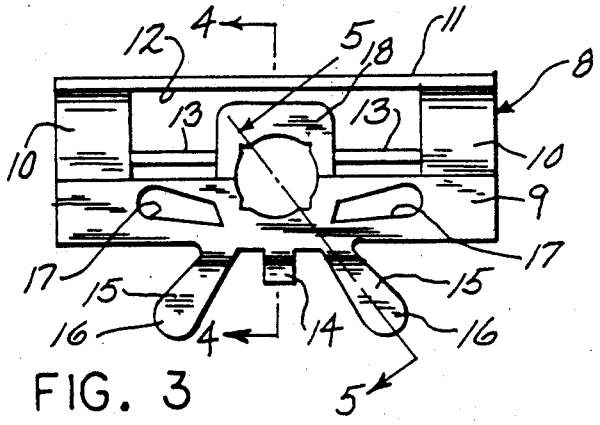
FIG. 3 is a front elevation of the deflector plate.

As best illustrated in FIG. 3, section 9 is also provided with a pair of horizontally elongated holes 17, each of which is spaced beneath one of the flanges 13.

When cap 6 is released to permit the discharge of water through outlet 2, the water being discharged is in a generally cylindrical stream and is divided as it engages the junction 5. The horizontal plate 11 directs the stream outwardly away from the ceiling and aids in propelling the water across the room, while the reverse bent area 10 prevents the water from being deflected upwardly back against the ceiling The central portion 18 of section 9 located above junction 5 aids in distributing the water uniformly into the room and is instrumental in controlling the wetting of the side walls and far wall and also functions in propelling the water stream into the far corners.

The aperture 12, as well as the holes 17, function to direct the water stream outwardly and to the corners of the room, while the central tine 14 acts to direct the water back toward the mounting wall and the outer tines 15 aid in directing the water toward the back corners.

Thus, the deflector construction of the invention provides more uniform wetting of the walls of the room, as well as the near and far corners of the room.

Various modes of carrying out the invention are contemplated as being within the scope of the following claims particularly pointing out and distinctly claiming the subject matter which is regarded as the invention.

I claim:

1. A side wall sprinkler head, comprising a body defining an outlet to be connected to a water line and having an axis, a pair of arms extending outwardly from the body and disposed in a common horizontal plane, the outer ends of said arms being connected at a junction, a cap to enclose the outlet, releasable means interconnecting the cap and the junction and constructed and arranged to release said cap to permit discharge of water from said outlet when said releasable means is exposed to a predetermined elevated temperature, a deflector connected to said junction and including a generally vertical section secured to said junction and extending normal to the axis of said outlet, said deflector also including a generally horizontal section connected to the upper edge of said vertical section through a reverse bent area, a first central tine extending downwardly from the lower edge of said vertical section and disposed in a longitudinal vertical plane extending through said axis, a pair of second tines connected to the lower edge of said vertical section and spaced laterally of said first tine, said second tines diverging downwardly and outwardly from said vertical plane, said vertical section having a pair of horizontally elongated openings with each opening disposed above a second tine, said bent area having a horizontally elongated aperture extending laterally to either side of said vertical plane, said second tines being raked rearwardly at an acute angle toward said body, and the lower extremities of said second tines being bent forwardly.

2. The sprinkler head of claim 1, and including a pair of horizontal flanges extending outwardly from said vertical section on opposite sides of said vertical plane, each flange bordering the lower edge of said aperture.

3. The sprinkler head of claim 2, wherein each flange is spaced above one of said openings.

4. The sprinkler head of claim 1, wherein said tines are raked rearwardly at an angle of about 10°.

5. The sprinkler head of claim 1, wherein the lower extremity of said second tines are bent forwardly at an angle of about 25°.

6. A side wall sprinkler head, comprising a body defining an outlet to be connected to a water line and having an axis, a pair of arms extending outwardly from the body and disposed in a common horizontal plane, the outer ends of said arms being connected at a unction, a cap to enclose the outlet, releasable means interconnecting the cap and the junction and constructed and arranged to release said cap to permit discharge of water from said outlet when said releasable means is exposed to a predetermined elevated temperature, a deflector connected to said junction and including a generally vertical section secured to said junction and extending normal to the axis of said outlet, said deflector also including a generally horizontal section connected to the upper edge of said vertical section, said vertical section having a pair of horizontally elongated openings located on either side of said axis, said openings being disposed beneath said horizontal plane, and a plurality of tines extending downwardly from the lower edge of said vertical section.

7. The sprinkler head of claim 6, wherein said plurality of tines comprises a pair of tines with each tine disposed beneath one of said openings.

8. The sprinkler head of claim 6, wherein each opening is tapered in a longitudinal direction with the outer extremity of the opening having a greater vertical width than the inner extremity.

9. The sprinkler head of claim 5, wherein said tines are raked rearwardly at an acute angle towards said body and the lower extremity of each of said pair of tines is bent forwardly.

* * * * *